United States Patent [19]

Jensen

[11] Patent Number: 5,051,666

[45] Date of Patent: Sep. 24, 1991

[54] CIRCUIT FOR STARTING AND OPERATING A GAS DISCHARGE LAMP

[76] Inventor: Kaj Jensen, Kaerparken 4, 2800 Lyngby, Denmark

[21] Appl. No.: 555,470

[22] PCT Filed: Feb. 17, 1989

[86] PCT No.: PCT/NO89/00036

§ 371 Date: Aug. 16, 1990

§ 102(e) Date: Aug. 16, 1990

[87] PCT Pub. No.: WO89/07877

PCT Pub. Date: Aug. 24, 1989

[30] Foreign Application Priority Data

Feb. 19, 1988 [DK] Denmark ..... 893/88

[51] Int. Cl.[5] ..... H05B 41/14

[52] U.S. Cl. ..... 315/307; 315/151; 315/DIG. 7

[58] Field of Search ..... 315/151, 158, 307, DIG. 165, 315/DIG. 167

[56] References Cited

U.S. PATENT DOCUMENTS 4,928,038 5/1990 Nerone ..... 315/209 R

*Primary Examiner*—David Mis

*Attorney, Agent, or Firm*—Merchant & Gould, Smith, Edell, Welter & Schmidt

[57] ABSTRACT

A circuit for starting and operating a gas discharge lamp (11) comprises: a DC power supply (73), which generates a DC power supply voltage; a high voltage generator (16, 18), which generates a high DC starting voltage from the DC power supply voltage and supplies the high DC starting voltage to the gas discharge lamp (11) so as to bring about a current flow therethrough; and inductor (15), which is connected in a closed loop circuit together withthe gas discharge lamp (11); a sensor (48), which is connected to the closed loop circuit for detecting the transmission of power therein; and a power switching (59, 60), which is switchable between a conducting state in which power is induced into the inductor (15) and a non-conducting state in which no power is induced into the inductor (15), and which is controlled by the sensor (48).

9 Claims, 2 Drawing Sheets

CIRCUIT FOR STARTING AND OPERATING A GAS DISCHARGE LAMP

Figure 1:
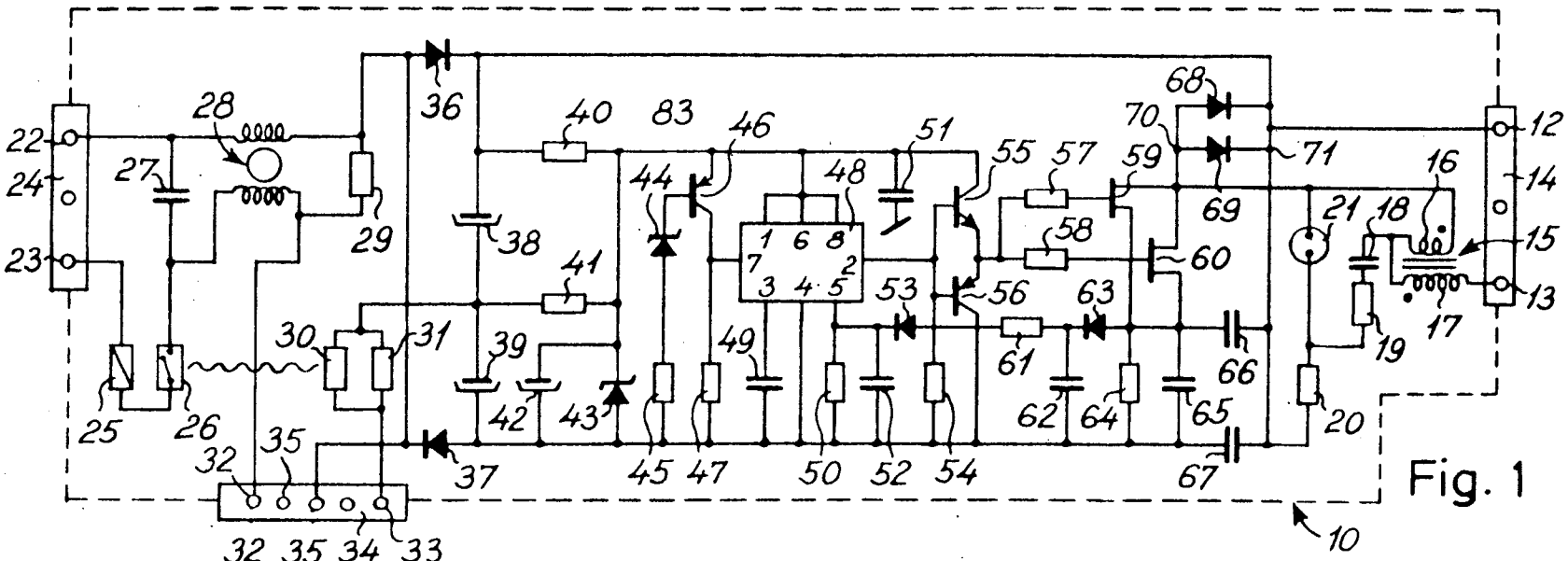

The present invention relates to a circuit for starting and operating a gas discharge lamp.

A gas discharge lamp is a lamp, which emits light in an electric discharge in the gas of the gas discharge lamp. In the present context, the term "gas discharge lamp" is a generic term comprising all lamps different from incandescent lamps, such as conventional gas discharge lamps, fluorescent lamps, halide lamps and arc lamps.

Common to all gas discharge lamps is the distinct shift in the characteristic of the gas discharge lamp, when the lamp is shifted from its off-state to its on-state and further the requirement of the gas discharge lamp of exceeding a threshold of electric energy supply for switching the gas discharge lamp from its off-state to its on-state. In its off-state, the gas discharge lamp represents a high electric impedance, whereas in its on-state the gas discharge lamp represents a basically resistive load or is to be considered equivalent to a resistance of finite value. Since the electric resistance represented by the gas discharge lamp in its on-state is a decreasing function of the RMS (root mean square) current supplied to the lamp, the lamp has to be connected with a ballast impedance in series with the lamp itself in order to limit the current supply to the lamp when the lamp is in its on-state on a constant voltage supply such as a mains supply. From the above, it is further understood that a starting circuit has to be provided in order to supply sufficient energy in excess of the above mentioned threshold for shifting the gas discharge lamp from its off-state to its on-state.

Several ballast and starter circuit configurations of passive and active circuit configurations are known in the art. Common to the passive circuit configurations of the ballast and starter circuits is the well-known ignition problem resulting in the emission of light flashes prior to the shift of the gas discharge lamps from their off-state to their on-state, as the passive circuit configurations are not able to positively shift the gas discharge lamps from their off-state to their on-state, and the unstable emission of light from the gas discharge lamps often perceived as a constant flickering of the light emitted.

A particular type of gas discharge lamp is a high power discharge lamp, such as a metal vapour lamp, a halide lamp, arc lamp, etc. In the present context, the term "high power gas discharge lamp" means a gas discharge lamp, which in its operating state or on-state receives power in excess of 200 W such as 300 W-2 kW, e.g. 350 W-1.2 kW from its ballast circuit. A highly relevant application of such high power gas discharge lamps is within the field of street-lighting. Thus, high power halide lamps are often used for enlightening highways, etc. These high power halide lamps used for street-lightning have hitherto been supplied from passive starter and ballast circuits as no commercially successful active starter and ballast circuit configuration has yet been available.

Thus, there is a need for an active circuit for starting and operating a gas discharge lamp, particularly a high power gas discharge lamp, which active circuit on the one hand eliminates the well-known slow starting and light-flickering problems of the passive ballast and starter circuit configurations, and the problems of restarting a halide lamp, which has been powered from the passive ballast and starter circuit and consequently been heated to an elevated temperature and is to be restarted or reignited after e.g. a mains supply failure, and which active circuit on the other hand is of a fairly simple and reliable circuit configuration and may be implemented in an inexpensive and lightweight structure, which compared to conventional, passive ballast and starter circuit configurations is much leighter, e.g. of a weight constituting merely 20–30% of the weight of the passive circuit configuration, however, is not more expensive than the corresponding passive ballast and starter circuit.

This need is fulfilled by a circuit according to the present invention for starting and operating a gas discharge lamp having a DC power supply means including a pair of DC power supply terminals and generating a DC power supply voltage across said pair of DC power supply terminals, a high voltage generator means connected to said pair of DC power supply terminals and to said pair of terminals of said gas discharge lamp and generating a high DC starting voltage from said DC power supply voltage, provided no current is flowing through said gas discharge lamp, which high DC starting voltage is supplied to said pair of terminals of said gas discharge lamp so as to bring about a current flow through said gas discharge lamp, an inductor means connected in a closed loop circuit together with said gas discharge lamp in which closed loop circuit power is transmitted from said inductor means to said gas discharge lamp, while current is flowing through said gas discharge lamp, a sensor means connected to said closed loop circuit and detecting said transmission of power from said inductor means to said gas discharge lamp, and a power switching means interconnecting said DC power supply means and said closed loop circuit and switchable between a conducting state in which said power switching means induces power into said inductor means from said DC power supply means and a non-conducting state in which no power is induced into said inductor means from said DC power supply means through said power switching means, which power switching means is controlled by said sensor means so as to switch said power switching means from its conducting state to its non-conducting state and vice versa for maintaining said current flow through said gas discharge lamp in said closed loop circuit.

Contrary to the known passive and active circuit configurations for starting and operating a gas discharge lamp, the circuit according to the present invention supplies the gas discharge lamp connected thereto with DC power or more correctly with modulated DC power, as the DC power transmitted from the DC power supply means to the gas discharge lamp is modulated by the switching of the power switching means of the circuit according to the invention from its conducting state to its non-conducting state and vice versa. It is, however, to be realised that some fluorescent lamps cannot be operated by the circuit according to the present invention as the supply of DC power to the fluorescent lamp results in a polarization of the gas of the fluorescent lamps and in an unhomogeneous light emission from the lamp. High power halide lamps, such as halide lamps receiving 300 W or more, e.g. 1 kW, may advantageously be operated and started by a circuit according to the present invention, which circuit surprisingly is capable of restarting a warm halide lamp before the halide lamp has been cooled. The circuit according to the present invention is further based on the realisation that a closed loop circuit comprising an inductor means and a gas discharge lamp, which gas dicharge lamp has been turned to its on-state and consequently constitutes a finite resistive impendance, will provide a substantially constant current and power flow through the gas discharge lamp, provided electrical power or energy is stored in the inductor means. The inductor means inherently attempts to maintain a constant current flow through itself. Provided the gas discharge lamp has been ignited or started and provided the electric power or energy is stored in the inductor means connected in said closed loop circuit further comprising the gas discharge lamp, the current flow through the gas discharge lamp may according to the teachings of the present invention be maintained by periodically inducing or transmitting power to the inductor means from the DC power supply means through the power switching means as the power switching means is switched to its conducting state. As will be understood, the circuit according to the present invention may be implemented in accordance with numerous electronic circuit implementations known per se in the art, however, a particularly preferred embodiment of the circuit according to the present invention will be described in greater detail.

A particular aspect of the circuit according to the present invention is the ability of controlling the power switching means in accordance with a specific requirement in order to obtain a specific emission characteristic intensity, etc. of the light emitted from the gas discharge lamp connected to the circuit according to the present invention. Thus, the power switching means of the circuit according to the present invention may in accordance with a first embodiment of the circuit according to the present invention be controlled by the sensor means so as to maintain the transmission of power from the inductor means to the gas discharge lamp within specific limits so as to ensure a substantially constant transmission of power from said inductor means to said gas discharge lamp in said closed loop circuit, and to obtain a substantially constant power emission from the gas discharge lamp. The power emission from the gas discharge lamp may be altered by altering said specific limits of power transmission.

In accordance with a further or alternative embodiment of the circuit according to the present invention, the sensor means is connected to the power switching means through a controlling means constituting a closed control loop, said controlling means includes a light intensity detector means detecting the intensity of the light emitted from the gas discharge lamp so as to maintain a substantially constant intensity of light. It is believed that the above embodiment comprising a closed control loop for maintaining a substantially constant intensity of light detected by said light intensity detector means may advantageously be employed in numerous applications. Consequently, in some applications, the intensity of light emitted from the gas discharge lamp may be maintained constantly controlled in the closed control loop constituted by the controlling means including the light intensity detector means. In an alternative application, the gas discharge lamp, e.g. an ultraviolet radiation emitting lamp, may be used for sterilizing an object or a liquid, e.g. water, and a closed control loop may, in this application of the circuit according to the present invention connected to a gas discharge lamp emitting ultraviolet radiation, maintain a specific contant UV intensity on the object or in the liquid.

The circuit according to the present invention may further or alternatively be modified so as to compensate for any ageing of the gas discharge lamp in that the sensor means may be connected to the power switching means through a controlling means, which includes a schedule representing the change of the intensity of the light emitted by the gas discharge lamp as a function of the age of the gas discharge lamp, and which controls the intensity of light emitted from the gas discharge lamp so as to maintain a substantially constant intensity of light.

As mentioned above, the circuit according to the present invention may be implemented in numerous ways, thus, the power switching means of the circuit may constitute a two-way switching means. The power switching means may include firstly a first power switching element interconnected between one terminal of the pair of DC power supply terminals and a first node of the closed loop circuit comprising the inductor means and the gas discharge lamp, and secondly a second power switching element interconnected between a second node of the closed loop circuit and a second terminal of said pair of DC power supply terminals. By operating the first and second power switching elements in synchronism so as to induce power into the inductor means, the circuit according to the present invention may be operated in accordance with the principles of the present invention. In accordance with the presently preferred embodiment of the circuit according to the present invention, the power switching means is constituted by a power transistor means having its gate connected to the sensor means and its conducting parts interconnected between a first node of the closed loop circuit and one terminal of the pair of DC power supply terminals, which closed loop circuit comprises a series connection of the inductor means and the gas discharge lamp and further a diode means. The diode means has a pair of electrode terminals and allows said current flow through said gas discharge lamp in one direction but blocks any current flow in the opposite direction. In the preferred embodiment one of the pair of electrode terminals of the diode means constitutes the first node of said closed loop circuit, and the other electrode terminal of the pair of electrode terminals of the diode means constitutes a second node of the closed loop circuit, which second node is connected to the other terminal of the pair of DC power supply terminals.

In accordance with the above described presently preferred embodiment of the circuit according to the present invention, a single power transistor means, which may comprise a parallel configuration of a plurality of power transistors, is employed for periodically inducing power into the inductor means. In order to ensure that the current flows in only one direction through the gas discharge lamp, a single diode means, which may comprise a plurality of diodes in a parallel configuration, is used.

It is to be realised that the high voltage generator means of the circuit according to the present invention may be implemented in accordance with numerous electronic circuit principles, e.g. in accordance with well-known circuit principles comprising high voltage ignition circuits known in the art per se. However, in the above described, presently preferred embodiment of the circuit according to the present invention, the inductor means also constitutes part of the high voltage generator means. Thus, the inductor means is in accordance with this embodiment of the circuit according to the present invention constituted by an auto transformer means having a primary winding and a secondary winding, which primary and secondary windings are connected in a series configuration in said closed loop circuit, which secondary winding has a number of windings which is larger than that of the primary winding, and in which preferred embodiment of the circuit the high voltage generator means comprises a gas arrestor means and a capacitor means, which gas arrestor means and which capacitor means are connected in a series connection in parallel with the primary winding of the auto transformer means. When the gas discharge lamp connected to the circuit according to the above described presently preferred embodiment of the present invention has not yet been shifted from its off-state to its on-state, and current is not yet flowing through the gas discharge lamp, the starting or ignition of the gas discharge lamp is effected very simply and extremely precisely and reliably as the DC power supplied to the inductor means from the DC power supply means through the power switching means results in the generation of a fairly high voltage across the capacitor means. When the voltage across the capacitor means exceeds the threshold voltage of the gas arrestor means, the gas arrestor means generates a short-circuit connection, through which the capacitor means is discharged through the primary winding of the auto transformer means, which auto transformer means at its secondary winding generates a specific high ignition voltage determined by the threshold voltage of the arrestor means and the number of windings of the primary and secondary windings of the auto transformer. Consequently, the specific and well-established and well-determined high voltage generated by the secondary winding of the auto transformer results in a reliable and precise ignition of the gas discharge lamp connected to the circuit according to the present invention.

The sensor means of the circuit according to the present invention is in the above described presently preferred embodiment of the circuit according to the present invention implemented by a DC/DC converter means having a detector input connected to the second node of the closed loop circuit and a control output connected to the gate of the transistor means. Consequently, the switching of the power switching transistor means from its conducting state to its non-conducting state and vice versa for inducing power into the inductor means of the circuit of the present invention is based on a detection of the DC voltage of the second node of the closed loop circuit, which DC voltage level is converted by the DC/DC converter means into a control output signal switching the power switching transistor means from its conducting state to its non-conducting state and vice versa.

Most often, the gas discharge lamp is to be supplied by a mains supply. Consequently, the circuit according to the present invention may advantageously comprise an AC/DC converter means for supplying the DC power supply means of the circuit form a mains supply. Further, in order to reduce any interference to and from the circuit according to the present invention from outer electric or electronic sources, the AC/DC converter means of the circuit according to the present invention may preferably comprise a radio frequency interference filtering means.

The AC/DC converter means may be implemented in accordance with well-known electronic circuit principles. Thus, the AC/DC converter means of the circuit according to the present invention may be constituted by e.g. a switch-mode power supply, a smoothed, stabilized or unstabilized DC power supply circuit well-known in the art per se. The AC/DC converter means may further comprise filtering means for reducing or eliminating highly reactive loading of the mains supply in order to reduce the deformation of the sinusoidal waveform of the mains supply voltage due to non-resistive loading of the mains supply, as the power switching means of the circuit according to the present invention is periodically shifted from its conducting state to its non-conducting state and vice versa and consequently periodically draws current from the mains supply. The filtering means of the AC/DC converter means may be constituted by conventional mains noise rejection filtering means.

It is to be realised that e.g. the AC/DC converter means, the filtering means etc. of the circuit according to the present invention may be implemented in accordance with the principles described in Applicant's International patent application No. PCT/DK87/00092, to which reference is made.

Figure 2:
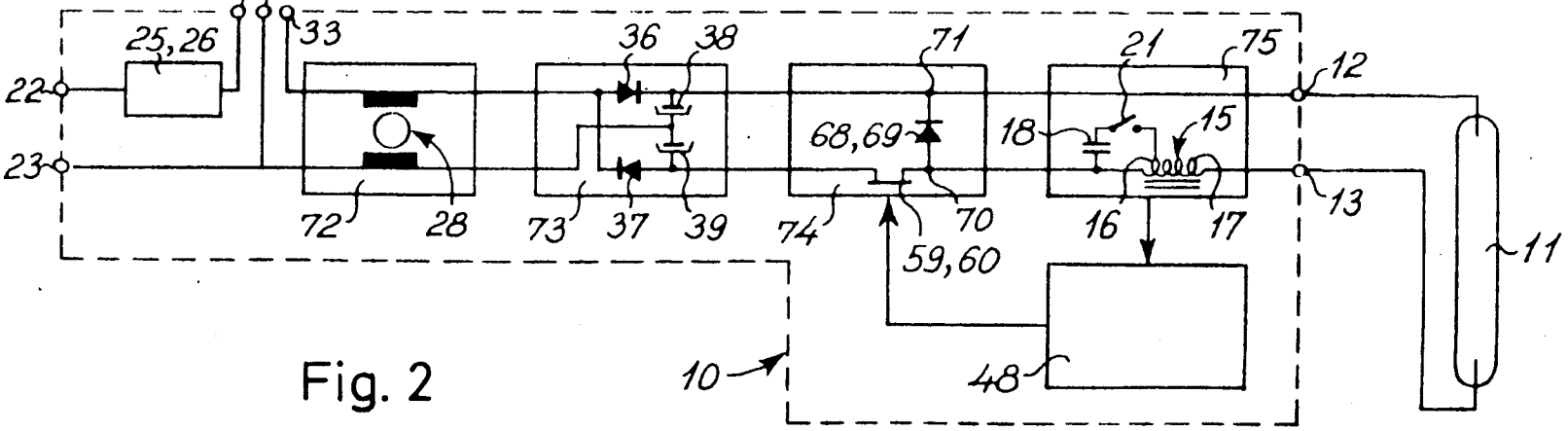
Figure 3:
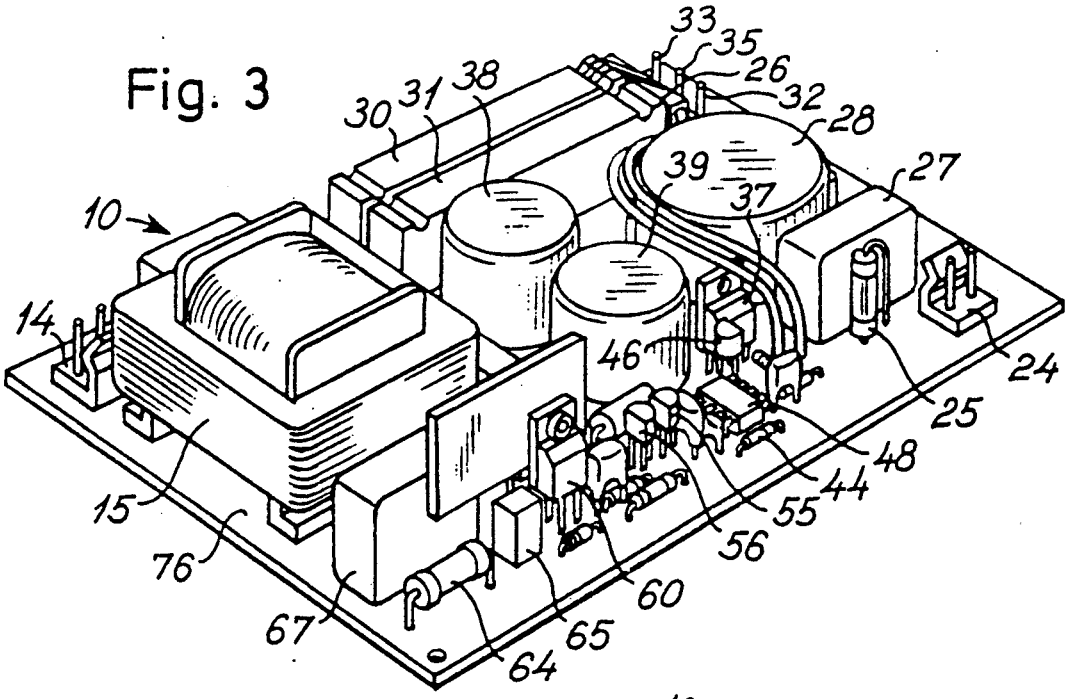
Figure 4:
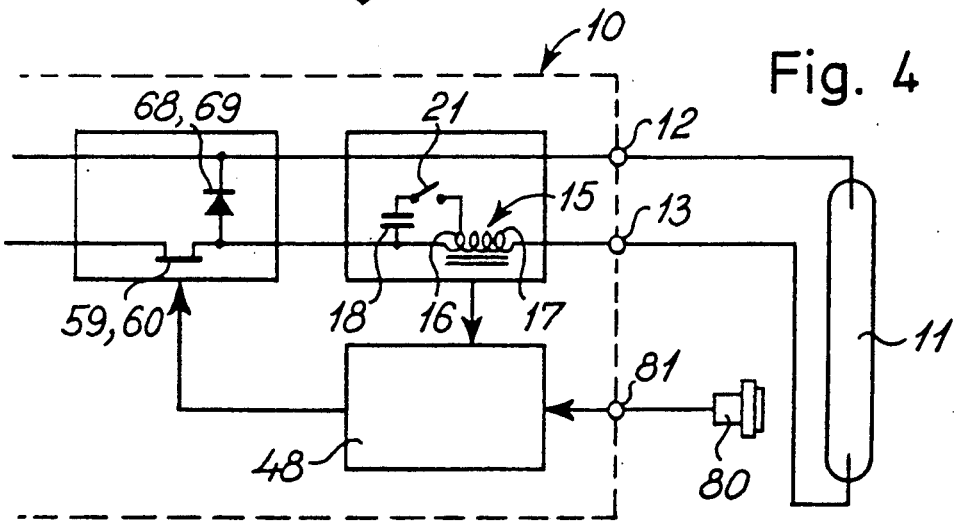
Figure 5:
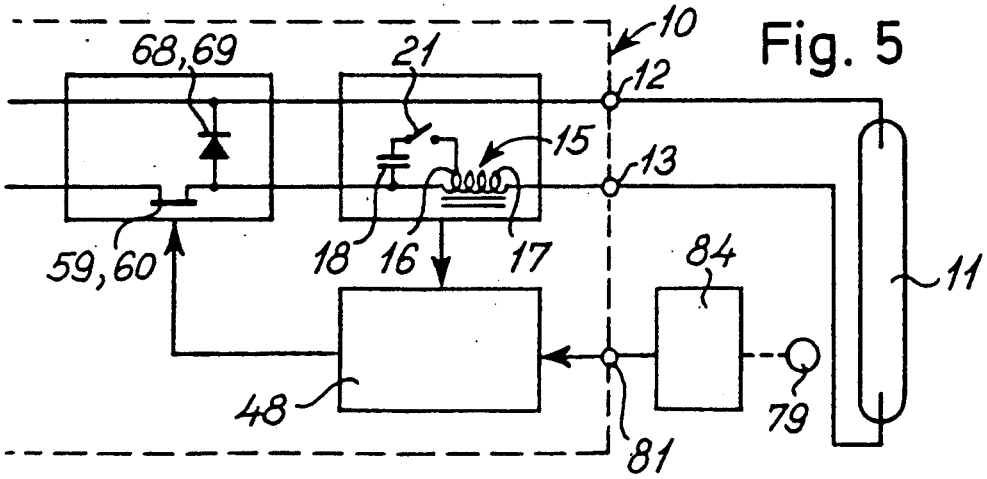

The invention will now be further described with reference to the drawings, in which FIG. 1 is a detailed diagrammatical view of a presently preferred embodiment of a circuit according to the present invention for starting and operating a high power gas discharge lamp, such as a halide lamp, FIG. 2 is a schematical view illustrating the basic concept or principle of the circuit according to the present invention, FIG. 3 is a perspective and schematical view of an implementation of the presently preferred embodiment of the circuit according to the invention as shown in FIG. 1, FIGS. 4 and 5 are schematical views illustrating a specific feedback or control of the circuit according to the present invention.

In FIG. 2 a schematical view of the presently preferred implementation of an electronic circuit of a high power, such as a 350 W ballast and starter circuit for a halide lamp is shown. The circuit is enclosed in a dotted line block and designated 10 in its entity. The circuit is supplied from a mains supply, such as a 220 V, 50 Hz or a 120 V, 60 Hz mains supply, and receives the mains DC voltage at a pair of mains supply terminals 22 and 23. The mains supply voltage is supplied to a block 72 including a radio frequency interference filter 28 through a fuse 25 and a temperature sensor 26 and through terminals 32, 33 and 35 to be described in greater detail below. The output of the block 72 and consequently the output of the radio frequency interference filter 28 is connected to inputs of a block 73 constituting an AC/DC converter or a DC power supply.

The block 73 includes two rectifier diodes 36 and 37 together constituting a half bridge rectifier and further two smoothing capacitors 38 and 39. Across the series configuration of the smoothing capacitors 38 and 39, a smoothed DC voltage is present, which smoothed DC voltage is supplied to the ballast and starter circuit according to the present invention. Obviously, the above described mains supply and DC power supply circuit may be amended in numerous ways, e.g. be substituted by a switch mode power supply, a stabilized DC power supply circuit, e.g. of the type described in International patent application No. PCT/DK87/00092, to which reference is made.

The circuit 10 according to the present invention further basically comprises two main circuit parts, viz. firstly a circuit part for starting or igniting a gas discharge lamp, which may be a halide lamp, an arc lamp, or in some cases a fluorescense tube, which may also be supplied from a DC supply circuit, which gas discharge lamp is designated 11 and connected to a pair of terminals 12 and 13, and secondly a circuit for maintaining a DC current flow through the gas discharge lamp 11, after the gas discharge lamp 11 has been ignited by the above first mentioned circuit part.

It is assumed that the gas discharge lamp 11 has been shifted from its off-state, in which it constitutes an extremely high impedance load to its on-state, in which it constitutes a resistive load, however, a resistive load of negative incremental voltage dependency. As the gas discharge lamp 11 has been ignited, a DC current flows from the terminal 12, through the lamp 11 to the terminal 13. As is evident from FIG. 2, the terminals 12 and 13 of the circuit 10 are connected to a series connection of an auto transformer 15 comprising a primary winding 16 and a secondary winding 17 together constituting a high inductivity choke and a diode comprising a parallel connection of two diodes 68 and 69 also shown in FIG. 1. As is evident from FIGS. 1 and 2, the anodes of the diodes 68 and 69 are connected to a node designated 70, and the cathodes of the diodes 68 and 69 are connected to a node designated 71. Together, the lamp 11, the choke 15 and the diodes 68 and 69 constitute a closed loop circuit, in which power accumulated in the choke 15 is supplied to the lamp 11 through the diodes 68 and 69.

In FIG. 2, the choke 15 is enclosed in a block designated 75 together with a capacitor 18 and a switch 21, which will be described below in greater detail with reference to FIG. 1, which capacitor 18 and switch 21 constitute components of the above first-mentioned circuit part for starting or igniting the gas discharge lamp 11. In FIG. 2 the diodes 68, 69 are enclosed in a block designated 74 which further includes power switching means constituted by two power MOS-FETs 59, 60 also shown in FIG. 1.

Furthermore, FIG. 2 shows a block 48 serving the purpose of controlling the power switches 59, 60, as will be described below. As mentioned above, it is assumed that the gas discharge lamp 11 has been turned on, so that a positive DC current is flowing from the high inductivity choke 15 in which the DC power has been induced and is stored through the diodes 68 and 69 to the terminal 12 and further through the gas discharge lamp 11 to the terminal 13. As is well known in the art, the choke 15 attempts to maintain a constant power flow through itself. However, as the power previously induced into the choke and stored therein is transferred to the gas discharge lamp 11, the current supplied from the choke 15 decreases. The decrease in current flow or in the power flow from the choke 15 to the lamp 11 is detected by the block 48, which controls the operation of the power MOS-FETs 59, 60, which have hitherto been in their non-conductive state, so that no current has flown from the node 70 through the power MOS-FETs 59 and 60. As the decrease in power and/or current flow from the choke 15 to the lamp 11 is detected by the block 48, the power MOS-FETs 59 and 60 are switched to their conducting state so that a current path is generated from the diode 36 of the block 73, through the node 71, the terminal 12, through the gas discharge lamp 11, through the terminal 13, through the secondary and primary windings 17 and 16, respectively, of the high inductivity choke 15, through the node 70 and further through the power MOS-FETs 59 and 60 to the diode 37. Consequently, power is transferred from the DC power supply block 73 to the high inductivity choke 15 by an increase in the current supplied through the choke 15, which power induced into the choke 15 is stored therein and later on, as the power MOS-FETs 59 and 60 are shifted into their non-conducting state controlled by the block 48, is transmitted through the diodes 68 and 69 to the gas discharge lamp 11 for maintaining the current flow therethrough and consequently for maintaining the gas discharge lamp in its on-state.

In FIG. 1, the electronic circuit 10 according to the present invention is shown in greater detail. Thus, in FIG. 1 the terminals 22 and 23 are illustrated as terminals of a three pole pin connector 24. Similarly, in FIG. 1 the terminals 32, 33 and 35 are illustrated as terminals of a five pole pin connector 34, and the terminals 12 and 13 are illustrated as terminals of a three pole pin connector 14. The above-mentioned fuse 25 and temperature sensor 26 are also shown in FIG. 1, where the temperature sensor 26 is schematically illustrated thermally communicating with a parallel connection of two high power resistors 30 and 31 as illustrated by a wavy line interconnecting the temperature sensor 26 and the resistor 30.

In the upper left hand part of FIG. 1, the radio frequency interference filter 28 is also shown together with accessory components comprising a capacitor 27 and a resistor 29 connected across the input terminals and the output terminals, respectively, of the radio frequency interference filter 28. As will be evident to the skilled art worker, the terminals 32, 33 and 35 of the five pole pin connector 34 serve the purpose of establishing electrically conductive connection between the terminals 32 and 33 through an on/off switch not shown on the drawings, and further between the terminal 32 and the terminal 35 through an indicator lamp, not shown on the drawings, which indicates that the mains supply circuit is turned on or alternatively turned off or disconnected from the mains supply in case the fuse 25 is blown or in case the temperature detector 26 has been heated by the resistors 30 and 31 to an elevated temperature detector 26 has been heated by the resistors 30 and 31 to an elevated temperature at which the temperature detector 26 disconnects the internal connection through the detector.

Centrally within the dotted line block 10 the block 48 is shown, which block 48 in the detailed circuit diagram shown in FIG. 1 is implemented by an integrated DC/DC converter circuit of the type MC34063. The pins 1, 6 and 8 of the integrated circuit 48 are connected to a positive supply rail 83, which is further connected to the cathode of the diode 36 or the node 71 through a resistor 40. The positive supply rail 83 is also connected to the ground of the circuit through a smoothing capacitor 51. As is evident from FIG. 1, pin 4 of the integrated circuit 48 is short-circuited to a negative supply rail 82 which is connected to the anode of the diode 37, and pin 3 of the integrated circuit 48 is connected to the negative supply rail through a capacitor 49. The node of the capacitors 38 and 39 is connected to the positive supply rail 83 through a resistor 41 and to the negative supply rail 82 through a parallel connection of a smoothing capacitor 42 and a Zener diode 43.

The positive supply rail 83 is also connected to an enabling circuit comprising two resistors 45 and 47, a Zener diode 44 and a PNP transistor 46, which enabling circuit has the collector of the PNP transistor 46 connected to pin 7 of the integrated circuit 48. The enabling circuit comprising the components 44–47 serves the purpose of disenabling the control block 48 in case the positive supply voltage present across the capacitor 51 and consequently across the positive and negative supply rails 83 and 82, respectively, is below a predetermined threshold determined by the Zener voltage of the Zener diode 44. As will be understood, the enabling circuit comprising the components 44–47 mainly serves the purpose of dis-enabling the control block 48, until the internal DC supply voltage of the circuit has reached an adequate level, as the entire electronic circuit 10 is turned on by connection to the mains supply.

The control output of the control block 48, which output is constituted by pin 2 of the integrated circuit 48, is connected to the negative supply rail 82 through a resistor 54 and to basis of a fully complementary transistor driver circuit comprising an NPN transistor 55 and a PNP transistor 56, which PNP transistor 56 has its collector connected to the negative supply rail 82, which NPN transistor 55 has its collector connected to the positive supply rail 83, and which transistors 55 and 56 have their emitters connected to the gates of the power MOS-FETs 59 and 60 through two resistors 57 and 58, respectively. The connecting parts of the power MOS-FETs 59 and 60 are connected between the node 70 and the negative supply rail 82 through a parallel connection of a current limiting resistor 64 and a capacitor 65. The node of the resistor 64, the capacitor 65 and the power MOS-FETs 59 and 60 is further connected to an anode of a diode 63 and through a capacitor 66 connected to the node 71. The node 71 is further connected to the negative supply rail 82 through a smoothing capacitor 67. The cathode of the diode 63 is connected to the negative supply rail 82 through a capacitor 62 and to an anode of a further diode 53 through a resistor 61, which further diode 63 has its cathode connected to pin 5 of the integrated circuit 48 and further to the negative supply rail 82 through a resistor 50 and a capacitor 52.

In the right hand part of FIG. 1, the auto transformer 15 is shown comprising its primary winding 16 and its secondary winding 17. The above-mentioned capacitor 18 and the switch 21 which is constituted by an arrestor or Diac is also shown together with a current limiting resistor 19 connected in series configuration with the capacitor 18 and a further resistor 20 establishing connection between the node of the resistor 19 and the arrestor or Diac 21.

Now, the ignition or starting operation of the circuit 10 is to be described in detail. Provided that the block or integrated circuit 48 has been enabled as discussed above, the DC/DC converter 48 switches its pin 2 high which results in that the power MOS-FETs 59 and 60 are turned on as the node of the emitters of the fully complementary transistor drivers 55 and 56 is also switched high. The node 70 is also shifted high, and a positive voltage is presented to the primary winding 16 of the high inductivity choke 15. A current is induced into the primary winding 16. However, as the gas discharge lamp 11 has not yet been ignited or started, the current path from the primary winding 16 through the secondary winding 17 and further through the gas discharge lamp 11 is disconnected, as the gas discharge lamp represents an extremely high impedance load. The current induced into the primary winding 16 results in the generation of a voltage across the capacitor 18. As the voltage across the capacitor 18 increases, the gas arrestor 21 suddenly provides a short circuiting connection through itself with the result that the voltage stored across the capacitor 18 is discharged through the current limiting resistor 19 and further through the primary winding 16 of the auto transformer 15 which from its primary winding 16 to its secondary winding 17 provides a transformation of the voltage applied to the primary winding 16 of the auto transformer so that a well defined, high ignition voltage is generated across the secondary winding 17 of the auto transformer 15. As will be understood, the ignition or starting voltage generated across the secondary winding 17 of the auto transformer 15 is determined by the threshold voltage of the gas arrestor 21 and further by the ratios of windings of the primary winding 16 and the secondary winding 17, exclusively. Consequently, a specific ignition or starting voltage is supplied to the gas discharge lamp, which ignition or starting voltage results in a positive ignition of the gas discharge lamp 11. In the presently preferred embodiment of the invention, the ignition voltage generated by the above described ignition or starting part of the electronic circuit according to the present invention is of the order of 3 kV.

The block 48 detects the voltage present across the capacitor 65 at its pin 5, which voltage represents the current flow through the gas discharge lamp 11. The voltage present across the capacitor 65 is transferred through a sample-and-hold circuit comprising the above-mentioned diode 63, the capacitor 62 and further through a voltage divider circuit comprising the resistors 61 and 50.

In FIG. 3, a perspective view of the presently preferred implementation of the above described electronic circuit 10 according to the present invention is shown mounted on a printed circuit board 76.

In FIGS. 4 and 5 a particular aspect of the present invention is illustrated. It should be realised that the light emitted from the discharge lamp 11 is generated by the DC current flowing through the gas discharge lamp and is controlled by the control block 48 in a closed control loop, as is evident from FIGS. 4 and 5. By the controlling of the light emission from the gas discharge lamp 11 in a closed control loop, the emission of light from the gas discharge lamp 11 may be modified or controlled in accordance with specific reuqirements by modifying the control block 48 or by amending the closed control loop. Thus, in FIG. 4 a light detector 80 is connected to the control block 48 through a terminal 81, which light detector 80 detects the intensity of light emitted from the gas discharge lamp 11 at the position of the light detector 80 and transfers information regarding the intensity of light detected to the control block 48 thereby influencing through the control block 48 the emission of light from the lamp 11.

Alternatively, as illustrated in FIG. 5, the control block 48 may be addressed through the terminal 81 from an external control means 84, such as a memory means including a schedule representing the decrease of the intensity of light emitted from a gas discharge lamp of the type in question, as the age of the gas discharge lamp increases. In FIG. 5, the external control block 84 is connected to a key 79, which constitutes a reset key to be activated when the gas discharge lamp 11 is substituted by a new one so as to reset the schedule. Further alternatively, the external control block 84 may be connected e.g. to a switch for alternating the intensity of light emitted by the gas discharge lamp by activating the switch.

It should be realised that the embodiment shown in FIG. 4 may advantageously be employed in connection with ultraviolet radiating lamps such as in sterilizing systems, e.g. for sterilizing drinking water. By arranging the light intensity detector 80 and the gas discharge lamp 11 emitting ultraviolet radiation on opposite side surfaces of an UV-transparent conduit, through which the drinking water is passed, the light intensity detector 80 may control the emission of ultraviolet radiation from the gas discharge lamp 11 so as to guarantee a minimum ultraviolet radiation exposion to any part of the drinking water. Alternatively, the drinking water sterilization system may be implemented by employing the alternative embodiment shown in FIG. 5, as the ultraviolet radiating gas discharge lamp 11 may be controlled by inputting information representing the water flow through the above-mentioned conduit into the control block 48 through the external control block 84, e.g. from a water flow meter or the like.

A further application of the electronic high power ballast and starter circuit according to the present invention is within the field of street-lighting and further within the field of photocopiers, in which the control aspects illustrated in FIGS. 4 and 5 may advantageously be employed.

A 120 V, 350 W implementation of the circuit shown in FIG. 1 was constructed from the following components:

The resistor 61 was constituted by a 22 Ω, metal film, 0.5 W, 1% resistor, the resistors 57 and 58 were constituted by 10 Ω, metal film, 0.5 W, 1% resistors, the resistor 50 was constituted by a 180 Ω, metal film, 0.5 W, 1% resistor, the resistor 54 was constituted by a 1 kΩ, metal film, 0.5 W, 1% resistor, the resistor 45 was constituted by a 10 kΩ, metal film, 0.5 W, 1% resistor, the resistor 47 was constituted by a 100 kΩ, metal film, 0.5 W, 1% resistor, the resistor 20 was constituted by a 1MΩ, metal film, 0.5 W, 1% resistor, the resistor 29 was constituted by a voltage dependent resistor, a 250 V varistor, the resistor 40 was constituted by a 27 kΩ, wire wound, minimum 7 W, 5% resistor, the resistor 41 was constituted by a 10 kΩ wire wound, minimum 7 W, 5% resistor, the resistors 64 and 19 were constituted by 1 Ω wire wound, minimum 5 W, 5% resistors, the resistors 30 and 31 were constituted by 3.9 Ω, wire wound, minimum 17 W, 10% resistors, the capacitor 66 was constituted by a 1 nF, 400 V, capacitor, the capacitor 49 was constituted by a 1 nF, 63 V, capacitor, the capacitor 51 was constituted by a 100 nF, 63 V, capacitor, the capacitors 52 and 62 were constituted by 220 nF, 63 V, capacitors, the capacitor 65 was constituted by a 680 nF, 63 V, capacitor, the capacitors 27, 67 and 18 were constituted by 2.2 μF, 400 V, polyester capacitors, the capacitor 42 was constituted by a 100 μF, 16 V, electrolytic, minimum 105° C., capacitor,

| | | Mains Voltage | | | | | |
|---|---|---|---|---|---|---|---|
| Mains Frequency 50 Hz | | 90 V | 100 V | 110 V | 120 V | 130 V | 140 V |
| Circuit cooled | $I_{in}$ | 4.9 A | 4.6 A | 4.1 A | 3.9 A | 3.7 A | 3.5 A |
| Lamp cooled | $P_{in}$ | 360 W | 360 W | 365 W | 370 W | 375 W | 380 W |
| | $I_{lamp}$ | 2.6 A | 2.6 A | 2.7 A | 2.8 A | 2.8 A | 2.9 A |
| Circuit not cooled | $I_{in}$ | 4.5 A | 4.1 A | 3.8 A | 3.6 A | 3.4 A | 3.2 A |
| Lamp not cooled | $P_{in}$ | 330 W | 335 W | 335 W | 340 W | 340 W | 345 W |
| | $I_{lamp}$ | 2.4 A | 2.4 A | 2.5 A | 2.5 A | 2.6 A | 2.6 A |
| Circuit cooled | $I_{in}$ | 5.0 A | 4.5 A | 4.2 A | 4.0 A | 3.8 A | 3.6 A |
| Lamp not cooled | $P_{in}$ | 370 W | 370 W | 370 W | 380 W | 385 W | 390 W |
| | $I_{lamp}$ | 2.6 A | 2.6 A | 2.6 A | 2.7 A | 2.8 A | 2.8 A |
| Circuit not cooled | $I_{in}$ | 4.5 A | 4.0 A | 3.7 A | 3.5 A | 3.3 A | 3.2 A |
| Lamp cooled | $P_{in}$ | 330 W | 330 W | 330 W | 330 W | 340 W | 340 W |
| | $I_{lamp}$ | 2.3 A | 2.3 A | 2.3 A | 2.3 A | 2.4 A | 2.4 A |

| | | Starting Test | | | | | |
|---|---|---|---|---|---|---|---|
| | t | 0 sec | 15 sec | 30 sec | 45 sec | 60 sec | 75 sec |
| 120 V - Warm lamp | $P_{in}$ | 160 W | 300 W | 420 W | 430 W | 350 W | 360 W |
| when started | $I_{lamp}$ | 4.6 A | 3.8 A | 3.3 A | 3.2 A | 2.6 A | 2.7 A |
| 120 V - Cold lamp | $P_{in}$ | 200 W | 180 W | 220 W | 300 W | 440 W | 360 W |
| when started | $I_{lamp}$ | 4.9 A | 4.8 A | 4.5 A | 4.0 A | 3.5 A | 2.8 A |
| Low voltage 90 V | $P_{in}$ | 180 W | 230 W | 340 W | 350 W | 360 W | 365 W |
| Hot lamp when started | $I_{lamp}$ | 4.6 A | 4.1 A | | 2.6 A | 2.6 A | 2.7 A |

$I_{in}$ is the current supplied from the mains supply to the electronic ballast and starter circuit, $P_{in}$ is the power supplied from the mains to the electronic ballast and starter circuit, and $I_{lamp}$ is the current supplied from the electronic ballast and starter circuit to the gas discharge lamp connected to the circuit.

EXAMPLE

It is to be noted that within a period of 60–75 sec, the lamp is operating at its normal operating power level.

the capacitors 38 and 39 were constituted by 470 μF, 350 V, electrolytic, minimum 85° C. capacitors, the auto transformer 15 was constituted by a 17 mH, minimum 4 A, choke the radio frequency interference filter 28 was constituted by an RFI filter, minimum 4 A, 6.8 mH, the transistors 59 and 60 were constituted by a 500 V MOS-FET, minimum 2 A, max. 1.5 Ω transistors, the transistors 46 and 56 were constituted by PNP 50 V, 0.6 A transistors, the transistor 55 was constituted by a NPN 50 V, 0.6 A transistor, the integrated circuit 48 was a Motorola MC 34063 integrated circuit, the diodes 36 and 37 were constituted by minimum 6 A, minimum 600 V, rectifier diodes, the diodes 53 and 63 were constituted by small signal Si diodes, the diodes 68 and 69 were constituted by fast, MIN 1 A, 400 V, max. 50 nS diodes, the Zener diode 44 was constituted by a 12 V, min. 0.5 W Zener diode, the Zener diode 43 was constituted by a 16 V, min. 1 W Zener diode, the fuse 25 was constituted by a 7 A fuse, the temperature detector 26 was constituted by a 85° C., 5% temperature detector, the switch or gas arrestor 21 was constituted by a gas arrestor or diac, the connectors 14 and 24 were three-pole pin connectors, min. 6 A, the connector 34 was a five-pole pin connector, min. 6 A, the entire electronic circuit was mounted on a coated printed circuit board 76.

Although the invention has been described with reference to a specific, preferred embodiment of the invention, it should be understood that numerous modifications and amendments, which will be obvious to a person having ordinary skill in the art, may be carried out without departing from the scope of the present invention as defined in the appending claims.

I claim:

1. A circuit for starting and operating a gas discharge lamp having a pair of terminals, said circuit comprising:

a DC power supply means including a pair of DC power supply terminals and generating a DC power supply voltage across said pair of DC power supply terminals, a high voltage generator means connected to said pair of DC power supply terminals and to said pair of terminals of said gas discharge lamp and generating a high DC starting voltage from said DC power supply voltage, provided no current is flowing through said gas discharge lamp, which high DC starting voltage is supplied to said pair of terminals of said gas discharge lamp so as to bring about a current flow through said gas discharge lamp, an inductor means connected in a closed loop circuit together with said gas discharge lamp in which closed loop circuit power is transmitted from said inductor means to said gas discharge lamp, while current is flowing through said gas discharge lamp, a sensor means connected to said closed loop circuit and detecting said transmission of power from said inductor means to said gas discharge lamp, and a power switching means interconnecting said DC power supply means and said closed loop circuit and switchable between a conducting state in which said power switching means induces power into said inductor means from said DC power supply means and a non-conducting state in which no power is induced into said inductor means from said DC power supply means through said power switching means, which power switching means is controlled by said sensor means so as to switch said power switching means from its conducting state to its non-conducting state and vice versa for maintaining said current flow through said gas discharge lamp in said closed loop circuit.

2. A circuit for starting and operating a gas discharge lamp having a pair of terminals, said circuit comprising:

a DC power supply means including a pair of DC power supply terminals and generating a DC power supply voltage across said pair of DC power supply terminals, a high voltage generator means connected to said pair of DC power supply terminals and to said pair of terminals of said gas discharge lamp and generating a high DC starting voltage from said DC power supply voltage, provided no current is flowing through said gas discharge lamp, which high DC starting voltage is supplied to said pair of terminals of said gas discharge lamp so as to bring about a current flow through said gas discharge lamp, an inductor means connected in a closed loop circuit together with said gas discharge lamp in which closed loop circuit power is transmitted from said inductor means to said gas discharge lamp, while current is flowing through said gas discharge lamp, a sensor means connected to said closed loop circuit and detecting said transmission of power from said inductor means to said gas discharge lamp, and a power switching means interconnecting said DC power supply means and said closed loop circuit and switchable between a conducting state in which said power switching means induces power into said inductor means from said DC power supply means and a non-conducting state in which no power is induced into said inductor means from said DC power supply means through said power switching means, which power switching means is controlled by said sensor means so as to switch said power switching means from its conducting state to its non-conducting state and vice versa for maintaining said current flow through said gas discharge lamp in said closed loop circuit, said power switching means being controlled by said sensor means so as to maintain said transmission of power from said inductor means to said gas discharge lamp within specific limits of power transmission so as to bring about a substantially constant transmission of power from said inductor means to said gas discharge lamp in said closed loop circuit.

3. A circuit for starting and operating a gas discharge lamp having a pair of terminals, said circuit comprising:

a DC power supply means including a pair of DC power supply terminals and generating a DC power supply voltage across said pair of DC power supply terminals, a high voltage generator means connected to said pair of DC power supply terminals and to said pair of terminals of said gas discharge lamp and generating a high DC starting voltage from said DC power supply voltage, provided no current is flowing through said gas discharge lamp, which high DC starting voltage is supplied to said pair of terminals of said gas discharge lamp so as to bring about a current flow through said gas discharge lamp, an inductor means connected in a closed loop circuit together with said gas discharge lamp in which closed loop circuit power is transmitted from said inductor means to said gas discharge lamp, while current is flowing through said gas discharge lamp, a sensor means connected to said closed loop circuit and detecting said transmission of power from said inductor means to said gas discharge lamp, and a power switching means interconnecting said DC power supply means and said closed loop circuit and switchable between a conducting state in which said power switching means induces power into said inductor means from said DC power supply means and a non-conducting state in which no power is induced into said inductor means from said DC power supply means through said power switching means, which power switching means is controlled by said sensor means so as to switch said power switching means from its conducting state to its non-conducting state and vice versa for maintaining said current flow through said gas discharge lamp in said closed loop circuit, said sensor means being connected to said power switching means through a controlling means constituting a closed controlling loop, said controlling means including a light intensity detector means detecting the intensity of the light generated by said gas discharge lamp so as to maintain a substantially constant intensity of light emitted detected by said light intensity detector means.

4. A circuit for starting and operating a gas discharge lamp having a pair of terminals, said circuit comprising:

a DC power supply means including a pair of DC power supply terminals and generating a DC power supply voltage across said pair of DC power supply terminals, a high voltage generator means connected to said pair of DC power supply terminals and to said pair of terminals of said gas discharge lamp and generating a high DC starting voltage from said DC power supply voltage, provided no current is flowing through said gas discharge lamp, which high DC starting voltage is supplied to said pair of terminals of said gas discharge lamp so as to bring about a current flow through said gas discharge lamp, an inductor means connected in a closed loop circuit together with said gas discharge lamp in which closed loop circuit power is transmitted from said inductor means to said gas discharge lamp, while current is flowing through said gas discharge lamp, a sensor means connected to said closed loop circuit and detecting said transmission of power from said inductor means to said gas discharge lamp, and a power switching means interconnecting said DC power supply means and said closed loop circuit and switchable between a conducting state in which said power switching means induces power into said inductor means from said DC power supply means and a non-conducting state in which no power is induced into said inductor means from said DC power supply means through said power switching means, which power switching means is controlled by said sensor means so as to switch said power switching means from its conducting state to its non-conducting state and vice versa for maintaining said current flow through said gas discharge lamp in said closed loop circuit, said sensor means being connected to said power switching means through a controlling means, said controlling means including a schedule representing the change of the intensity of the light emitted by said gas discharge lamp as a function of the age of the gas discharge lamp and controlling the intensity of light emitted from said gas discharge lamp so as to maintain a substantially constant intensity of light emitted from said gas discharge lamp by compensation for the ageing of the gas discharge lamp.

5. A circuit for starting and operating a gas discharge lamp having a pair of terminals, said circuit comprising:

a DC power supply means including a pair of DC power supply terminals and generating a DC power supply voltage across said pair of DC power supply terminals, a high voltage generator means connected to said pair of DC power supply terminals and to said pair of terminals of said gas discharge lamp and generating a high DC starting voltage from said DC power supply voltage, provided no current is flowing through said gas discharge lamp, which high DC starting voltage is supplied to said pair of terminals of said gas discharge lamp so as to bring about a current flow through said gas discharge lamp, an inductor means connected in a closed loop circuit together with said gas discharge lamp in which closed loop circuit power is transmitted from said inductor means to said gas discharge lamp, while current is flowing through said gas discharge lamp, a sensor means connected to said closed loop circuit and detecting said transmission of power from said inductor means to said gas discharge lamp, and a power switching means interconnecting said DC power supply means and said closed loop circuit and switchable between a conducting state in which said power switching means induces power into said inductor means from said DC power supply means and a non-conducting state in which no power is induced into said inductor means from said DC power supply means through said power switching means, which power switching means is controlled by said sensor means so as to switch said power switching means from its conducting state to its non-conducting state and vice versa for maintaining said current flow through said gas discharge lamp in said closed loop circuit, said power switching means being constituted by a power transistor means having its gate connected to said sensor means and its conducting parts interconnected between a first node of said closed loop circuit and one terminal of said pair of DC power supply terminals, said closed loop circuit comprising a series connection of said inductor means and said gas discharge lamp and further a diode means having a pair of electrode terminals and allowing said current flow through said gas discharge lamp but blocking any current flow in the opposite direction through said gas discharge lamp, one of said pair of electrode terminals of said diode means constituting said first node of said closed loop circuit and the other electrode terminal of said pair of electrode terminals of said diode means constituting a second node of said closed loop circuit, which second node is connected to the other terminal of said pair of DC power supply terminals.

6. A circuit according to claim 5, said inductor means being constituted by an auto transformer means having a primary winding and a secondary winding, said primary and secondary windings being connected in a series configuration in said closed loop circuit, the number of windings of said secondary winding being larger than that of said primary winding, said high voltage generator means comprising a gas arrestor means and a capacitor means, and said gas arrestor means and said capacitor means being connected in a series connection in parallel with said primary winding of said auto transformer means.

7. A circuit according to claim 5, said sensor means comprising a DC/DC converter means having a detector input connected to said second node of said closed loop circuit and a control output connected to said gate of said transistor means.

8. A circuit for starting and operating a gas discharge lamp having a pair of terminals, said circuit comprising:

a DC power supply means including a pair of DC power supply terminals and generating a DC power supply voltage across said pair of DC power supply terminals, a high voltage generator means connected to said pair of DC power supply terminals and to said pair of terminals of said gas discharge lamp and generating a high DC starting voltage from said DC power supply voltage, provided no current is flowing through said gas discharge lamp, which high DC starting voltage is supplied to said pair of terminals of said gas discharge lamp so as to bring about a current flow through said gas discharge lamp, an inductor means connected in a closed loop circuit together with said gas discharge lamp in which closed loop circuit power is transmitted from said inductor means to said gas discharge lamp, while current is flowing through said gas discharge lamp, a sensor means connected to said closed loop circuit and detecting said transmission of power from said inductor means to said gas discharge lamp, a power switching means interconnecting said DC power supply means and said closed loop circuit and switchable between a conducting state in which said power switching means induces power into said inductor means from said DC power supply means and a non-conducting state in which no power is induced into said inductor means from said DC power supply means through said power switching means, which power switching means is controlled by said sensor means so as to switch said power switching means from its conducting state to its non-conducting state and vice versa for maintaining said current flow through said gas discharge lamp in said closed loop circuit, and an AC/DC converter means for supplying said DC power supply means from a mains supply.

9. A circuit according to claim 8, said AC/DC converter means comprising a radio frequency interference filter means.

* * * * *

UNITED STATES PATENT AND TRADEMARK OFFICE

CERTIFICATE OF CORRECTION

PATENT NO. : 5,051,666

DATED : 24 September 1991

INVENTOR(S) : Kaj Jensen

It is certified that error appears in the above-identified patent and that said Letters Patent is hereby corrected as shown below:

On the Title page, item [57]:

Abstract, line 8 delete "and" and insert --an--.

Abstract, line 9 delete "withthe" and insert --with the--.

Column 8, lines 51 and 52 delete "detector 26 has been heated by the resistors 30 and 31 to an elevated temperature" after the word "temperature".

Column 11 & 12 under "Starting Test" starting test 5 was started on wrong line, it should read as follows:

| | | | | | | | |
|---|---|---|---|---|---|---|---|
| Low voltage 90 V Hot Lamp when started | $P_{in}$ | 180 W | 230 W | 340 W | 350 W | 360 W | 365 W |
| | $I_{lamp}$ | 4.6 A | 4.1 A | | 2.6 A | 2.6 A | 2.7 A |

Signed and Sealed this

Tenth Day of August, 1993

*Attest:*

*Attesting Officer*

Michael K. Kirk

MICHAEL K. KIRK

*Acting Commissioner of Patents and Trademarks*